United States Patent [19]

House et al.

[11] 4,342,292

[45] Aug. 3, 1982

[54] IGNITION DISTRIBUTOR

[75] Inventors: Ronnalee House; Byron W. Johnson, both of Anderson, Ind.

[73] Assignee: General Motors Corporation, Detroit, Mich.

[21] Appl. No.: 198,367

[22] Filed: Oct. 20, 1980

[51] Int. Cl.[3] ..... F02P 5/00; F02P 7/00; H01H 19/00

[52] U.S. Cl. ..... 123/146.5 A; 200/19 R

[58] Field of Search ..... 123/146.5 A; 200/19 DC, 200/19 R, 19 DR, 306, 19 A, 21, 24

[56] References Cited

U.S. PATENT DOCUMENTS

| | | | |
|---|---|---|---|
| 3,646,922 | 3/1972 | Spalding | 123/146.5 A |
| 3,799,135 | 3/1974 | House | 123/146.5 A |
| 4,096,840 | 6/1978 | Jordan | 123/146.5 A |
| 4,129,107 | 12/1978 | Boyar | 123/146.5 A |
| 4,153,030 | 5/1979 | Power et al. | 123/146.5 A |
| 4,182,940 | 1/1980 | Scussel et al. | 123/146.5 A |
| 4,186,286 | 1/1980 | Kuo et al. | 123/146.5 A |
| 4,225,759 | 9/1980 | Fox et al. | 123/146.5 A |

FOREIGN PATENT DOCUMENTS

| | | |
|---|---|---|
| 527126 | 10/1940 | United Kingdom . |
| 541262 | 11/1941 | United Kingdom . |

*Primary Examiner*—Raymond A. Nelli
*Attorney, Agent, or Firm*—Richard G. Stahr

[57] ABSTRACT

In an internal combustion engine ignition distributor, an ignition spark energy conductive circuit arranged for connection to the secondary winding of an ignition coil is so formed and positioned that it is substantially equally radially spaced from each of the distributor output circuits and an annular insulating rib rotated with the rotor is disposed within the space between the ignition spark energy conductive circuit and the distributor output circuits. The annular insulating rib supports and locates radial circumferentially spaced juxtaposed conductive inserts in spark gap relationship with both the ignition spark energy conductive circuit and successive ones of the distributor output circuits upon the rotation thereof.

8 Claims, 10 Drawing Figures

IGNITION DISTRIBUTOR

This invention is directed to internal combustion engine ignition distributors and, more specifically, to an ignition distributor in which an annular insulating rib arranged to be rotated in timed relationship with the engine is disposed within the space between an ignition spark energy conductive circuit and each of the distributor output circuits and supports and locates radial circumferentially spaced juxtaposed conductive inserts in spark gap relationship with both the ignition spark energy conductive circuit and successive ones of the distributor output circuits when rotated.

Modern motor vehicle internal combustion engine ignition systems may deliver ignition spark energy of the order of 40,000 volts or more. Also, to realize improved engine operating efficiency, it is necessary that the ignition spark adjustment range between maximum ignition spark retard and maximum ignition spark advance be significantly increased. For any given distributor size, an increase of the ignition spark adjustment range with this high ignition spark potential may result in distributor cross fire between the conductive segment rotated with the distributor rotor and one of the stationary distributor output terminals other than the one to which the ignition spark energy is to be directed. One way to prevent undesirable distributor cross fire is to increase the distance the ignition spark energy must travel to cross fire to either of the distributor output electrodes adjacent the output electrode to which it should be directed. Although this distance may be increased by increasing the distance between adjacent distributor output electrodes, the attendant increase of distributor circumference may be undesirable and in case of space limitations, unacceptable. Therefore, an ignition distributor that provides an increased ignition spark energy adjustment range by having an increased ignition spark energy travel distance to the two stationary distributor output electrodes adjacent the distributor output electrode to which the ignition spark energy should be directed without increasing distributor circumference is desirable.

It is, therefre, an object of this invention to provide an improved internal combustion engine ignition distributor.

It is another object of this invention to provide an improved internal combustion engine ignition distributor in which an annular insulating rib arranged to be rotated in timed relationship with the engine is disposed within the space between an ignition spark energy conductive circuit and the distributor output circuits and supports and locates radial circumferentially spaced juxtaposed conductive inserts in spark gap relationship with both the ignition spark energy conductive circuit and successive ones of the distributor output terminals when rotated.

In accordance with this invention, an improved internal combustion engine ignition distributor for sequentially directing the ignition spark energy produced in an ignition coil secondary winding to the spark plugs of an associated engine is provided wherein an ignition spark energy conductive circuit connected to the ignition coil secondary winding is so formed and positioned that it is substantially equally radially spaced from the distributor output circuits and a rotor member arranged to be rotated in timed relationship with the engine has an annular insulating rib portion disposed within the space between the ignition spark energy conductive circuit and the distributor output circuits that supports and locates radial circumferentially spaced juxtaposed conductive inserts in spark gap relationship with both the ignition spark energy conductive circuit and the distributor output circuits when the rotor member is rotated.

For a better understanding of the present invention, together with additional objects, advantages and features thereof, reference is made to the following description and accompanying drawing in which.

Figure 1:
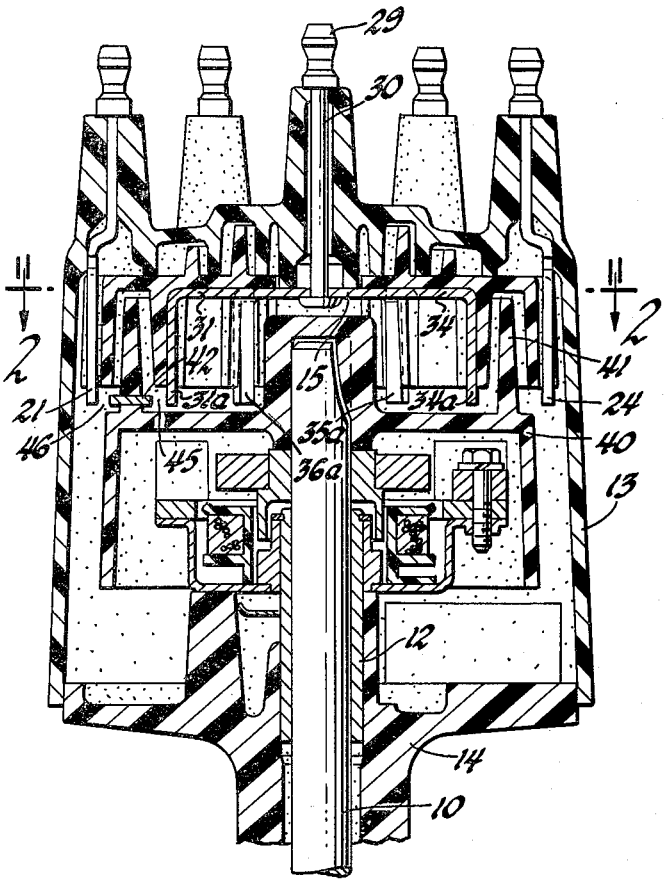
FIG. 1 is an elevation view in section of the ignition distributor of this invention.
Figure 3:
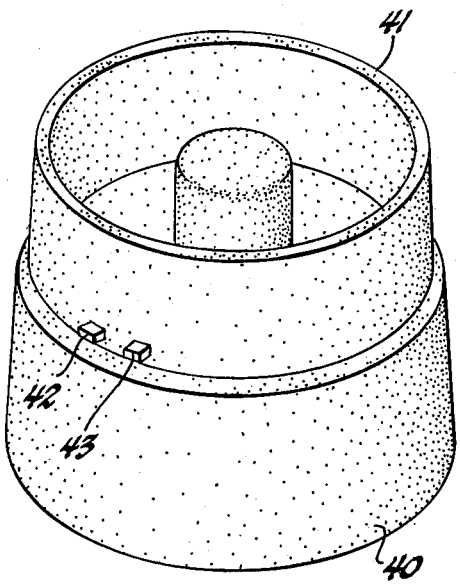
FIG. 3 is a perspective view of a rotor member employed in one embodiment of this invention.

In the interest of reducing drawing complexity and since internal combustion engines, ignition coils, spark plugs, ignition systems and the interconnecting ignition wiring are well known in the automotive art and, per se, form no part of this invention, these items have not been shown in the drawing.

FIGS. 1, 2, 3 and 5 of the drawing set forth one embodiment of an internal combustion engine ignition distributor in accordance with this invention for sequentially directing the ignition spark energy potential induced in the secondary winding of the engine ignition system ignition coil to the spark plugs of the engine.

With reference to FIG. 1 of the drawing, a distributor shaft 10 is journaled for rotation in a sleeve bearing 12 within the distributor base 14 in timed relationship with an associated internal combustion engine in a manner well known in the automotive art. As is also well known in the automotive art, an internal combustion engine ignition distributor is provided with a plurality of circumferentially disposed output circuits, each corresponding to one of the spark plugs of the associated internal combustion engine. In the drawing, these output circuits for an associated six-cylinder internal combustion engine are indicated to be in the form of stationary output electrodes supported by the distributor cap 13 and are referenced by the numerals 21–26, inclusive, with the second numeral designating the engine cylinder number. That is, output circuit electrode 21 corresponds to the spark plug of engine cylinder number one, output circuit terminal 22 corresponds to the spark plug of engine cylinder number two and so forth.

Figure 2:
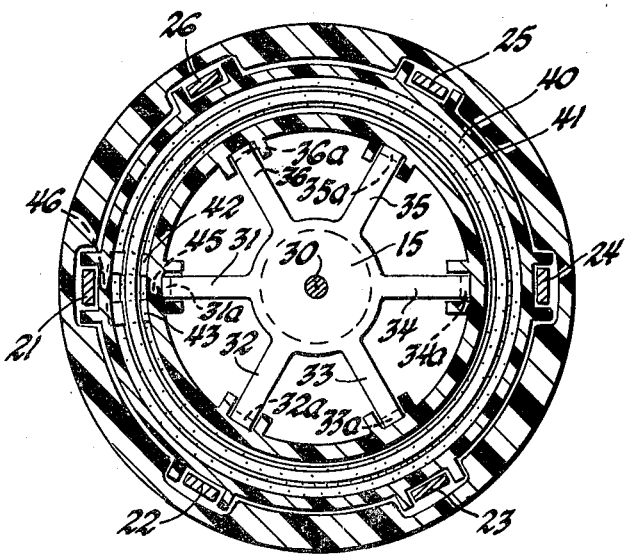
FIG. 2 is a section view of FIG. 1 taken along line 2—2 and looking in the direction of the arrows.

An ignition spark energy conductive circuit 15 through which the ignition spark energy potential may be conducted from the ignition coil secondary winding to the distributor output circuits is arranged for electrical connection to one side of the associated ignition coil secondary winding and is so formed and positioned that it is substantially equally radially spaced from each of the output circuits. Without intention or inference of a limitation thereto, the ignition spark energy conductive circuit 15 is illustrated in the drawing as a "spider" member of a conductive material, such as copper or aluminum, having a conductive member including a portion extending angularly therefrom corresponding to each output terminal. As best seen in FIG. 2, these conductive members are referenced by the numerals 31, 32, 33, 34, 35 and 36 and the respective angularly extending portions are referenced by the numerals 31*a*, 32*a*, 33*a*, 34*a*, 35*a* and 36*a*. With the arrangement of FIGS. 1 and 2, the ignition spark energy conductive circuit 15 is supported and positioned in such a manner that each of the conductive members is located in register with and radially spaced from the corresponding distributor output electrode and each respective angularly extending portion is in register with and radially spaced from the corresponding distributor output electrode. Although the ignition spark energy conductive circuit 15 has been illustrated in the drawing as a "spider" having radially extending conductive members with angularly extending portions, it is to be specifically understood that any other suitable configuration may be employed without departing from the spirit of the invention. For example, the angularly extending portions may be eliminated with some distributor designs or the ignition spark energy conductive circuit may be of a cylindrical configuration.

The ignition spark energy conductive circuit 15 is shown in FIG. 1 to be electrically connected to the distributor ignition spark energy potential input circuit terminal 29 through conductive element 30. As is well known in the automotive art, input circuit terminal 29 may be electrically connected to one side of the ignition coil secondary winding through an appropriate lead. In the interest of reducing drawing complexity and since automotive ignition coils are well known in the art and, per se, form no part of this invention, the ignition coil is not shown in the drawing. It is to be specifically understood, however, that one side of the secondary winding of the associated ignition coil may be directly connected to the ignition spark energy conductive circuit 15 without departing from the spirit of the invention. For example, with ignition distributors having the ignition coil located in the distributor cap, one of the leads of the secondary winding of the ignition coil may be connected to the ignition spark energy conductive circuit 15 through a carbon button.

A rotatable member 40 of an insulating material arranged to be rotated about a central axis in timed relationship with an associated internal combustion engine has an annular insulating rib portion 41 disposed between the ignition spark energy conductive circuit 15 and the distributor output circuit electrodes. As is well known in the automotive art, rotatable member 40 is keyed to distributor shaft 10 and is rotated with distributor shaft 10 while the associated engine is in the run mode. As a consequence, rotatable member 40 is rotated about a central axis in timed relationship with the associated engine.

In one embodiment of this invention, two radial circumferentially spaced juxtaposed conductive inserts 42 and 43 are supported by and extend through the annular insulating rib portion 41 of rotatable member 40 in such a location that each passes in spark gap relationship with both the ignition spark energy conductive circuit 15 and successive ones of the distributor output circuit electrodes when rotatable member 40 is rotated. As is illustrated best in FIGS. 1, 2 and 3, the two spaced juxtaposed conductive inserts 42 and 43 are supported by the annular insulating rib portion 41 of rotatable member 40 in a common plane that is substantially normal to the central axis about which rotor member 40 rotates and intersects both the ignition spark energy conductive circuit 15 and the distributor output circuit electrodes with conductive inserts 42 and 43 extending through the annular insulating rib portion 41 and being of such a radial dimension substantially in the direction of the common plane that each is in spark gap relationship with both the ignition spark energy conductive circuit 15 and successive ones of the distributor output electrodes when rotatable member 40 is rotated. In FIGS. 1 and 2 of the drawing, rotatable member 40 is illustrated to be in the position in which conductive inserts 42 and 43 are located in the space between the distributor output electrode 21 and the angularly extending portion 31*a* of conductive member 31 of the ignition spark energy conductive circuit 15. In this position, there is a spark gap 45 between the angularly extending portion 31*a* of conductive member 31 and conductive inserts 42 and 43 and another spark gap 46 between distributor output circuit electrode 21 and conductive inserts 42 and 43. Assuming that distributor shaft 10 rotates rotatable member 40 in a clockwise direction, there is a spark gap corresponding to spark gap 45 between conductive inserts 42 and 43 and the successive conductive members 36, 35, 34, 33 and 32 of ignition spark energy conductive circuit 15 and also a spark gap similar to spark gap 46 between conductive inserts 42 and 43 and successive ignition distributor output circuit electrodes 26, 25, 24, 23 and 22 that is the normal firing order 1-6-5-4-3-2 for a V-6 internal combustion engine.

Figure 5A:
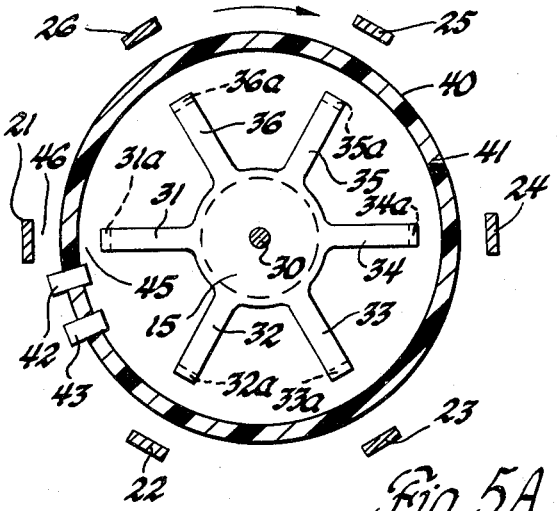
FIGS. 5A, 5B and 5C are a series of three diagrammatic representations of the rotor member of FIG. 3 at three different angular positions.
Figure 5B:
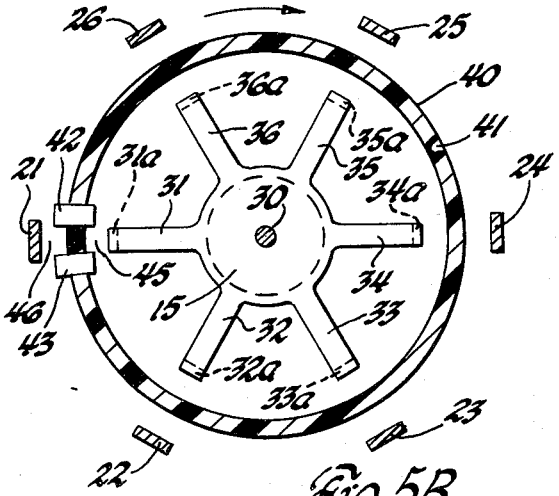
Figure 5C:
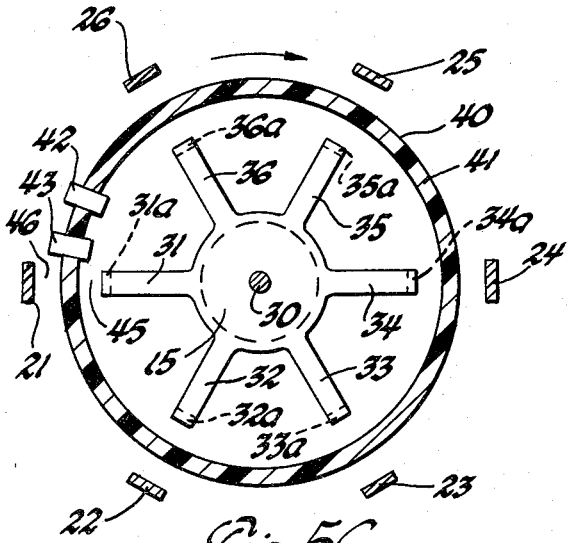

FIG. 5 diagrammatically sets forth three different angular positions of conductive inserts 42 and 43 with rotatable member 40 rotating in a clockwise direction as indicated by the arrows. Upon the occurrence of an ignition spark energy potential when conductive inserts 42 and 43 are in the position as indicated by FIG. 5A, the system is firing in the advance position and the ignition spark energy potential is transmitted from conductive member 31 of ignition spark energy conductive circuit 15 across spark gap 45 to conductive insert 42 and across spark gap 46 to distributor output electrode 21. Upon the occurrence of an ignition spark energy potential when conductive inserts 42 and 43 are in the position as indicated in FIG. 5B, the system is firing at the midpoint of the total distributor range. The ignition spark energy potential is transmitted from the conductive member 31 of ignition spark energy conductive circuit 15 across spark gap 45 to either or both of conductive inserts 42 and 43 and across spark gap 46 to distributor output electrode 21. Upon the occurrence of an ignition spark energy potential when conductive inserts 42 and 43 are in the position as indicated in FIG. 5C, the system is firing in the retard position and the ignition spark energy potential is transmitted from conductive member 31 of ignition spark energy conductive circuit 15 across spark gap 45 to conductive insert 43 and across spark gap 46 to distributor output electrode 21. When firing in the advance position as indicated by FIG. 5A, for the system to cross fire to distributor output electrode 22, the ignition spark energy must be transmitted from conductive member 31 of ignition spark energy conductive circuit 15 across spark gap 45 to conductive insert 42, across the gap between conductive inserts 42 and 43 and across the space between conductive insert 43 and distributor output electrode 22 or from conductive member 31 of ignition spark energy conductive circuit 15 to conductive insert 43 and thence to distributor output electrode 22. In either event, to cross fire to distributor output electrode 22, the ignition spark energy must travel a greater distance than to the proper distributor output electrode 21. When firing in the retard position as indicated by FIG. 5C, for the system to cross fire to distributor output electrode 26, the ignition spark energy must be transmitted from conductive member 31 of ignition spark energy conductive circuit 15 across spark gap 45 to conductive insert 43, across the gap between conductive inserts 43 and 42 and across the space between conductive insert 42 and distributor output electrode 26 or from conductive member 31 of ignition spark energy conductive circuit 15 to conductive insert 42 and thence to distributor output electrode 26. In either event, to cross fire to distributor output electrode 26, the ignition spark energy must travel a greater distance than to the proper distributor output electrode 21. This is because the two conductive inserts 42 and 43 essentially provide a split rotor tip.

Figure 4:
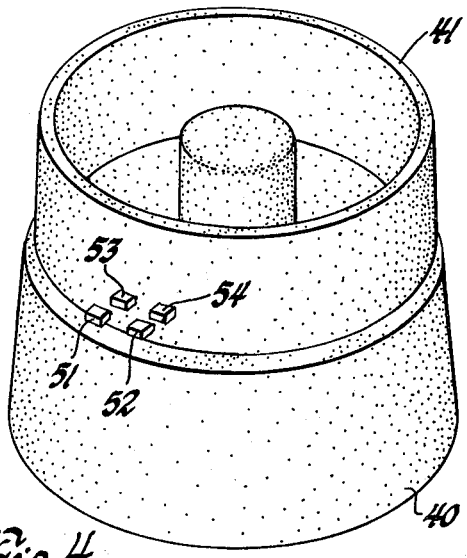
FIG. 4 is a perspective view of a rotor member employed in another embodiment of this invention.

In another embodiment of this invention as best seen in FIG. 4, two radial circumferentially spaced juxtaposed conductive inserts 51–52 and 53–54 in each of two respective substantially parallel planes are employed. These conductive inserts are supported by and extend through the annular insulating rib portion 41 of rotatable member 40 in such a location that each passes in spark gap relationship with both the ignition spark energy conductive circuit 15 and successive ones of the distributor output circuit electrodes when rotatable member 40 is rotated. As is illustrated best in FIGS. 4 and 6, the two spaced juxtaposed conductive inserts 51 and 52 are supported by the annular insulating rib portion 41 of rotatable member 40 in a first common plane that is substantially normal to the central axis about which rotor member 40 rotates and intersects both the ignition spark energy conductive circuit 15 and the distributor output circuit electrodes; the two spaced juxtaposed conductive inserts 53 and 54 are supported by the annular insulating rib portion 41 in a second common plane that is substantially normal to the central axis, is displaced from the first common plane substantially in the direction of the central axis and intersects both the ignition spark energy conductive circuit 15 and the distributor output circuit electrodes; and the conductive inserts of the respective planes are out of register. All of these conductive inserts extend through the annular insulating rib portion and are of such a radial dimension that each is in spark gap relationship with both the ignition spark energy conductive circuit and successive ones of the output circuit electrodes when the rotatable member 40 is rotated.

Figure 6A:
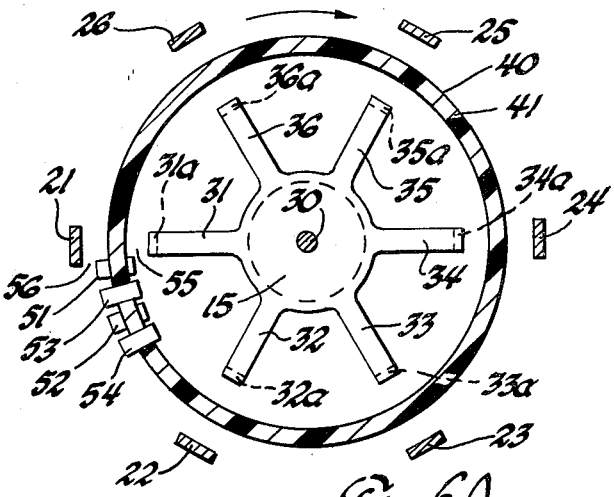
FIGS. 6A, 6B and 6C are a series of three diagrammatic representations of the rotor member of FIG. 4 in three different angular positions.
Figure 6B:
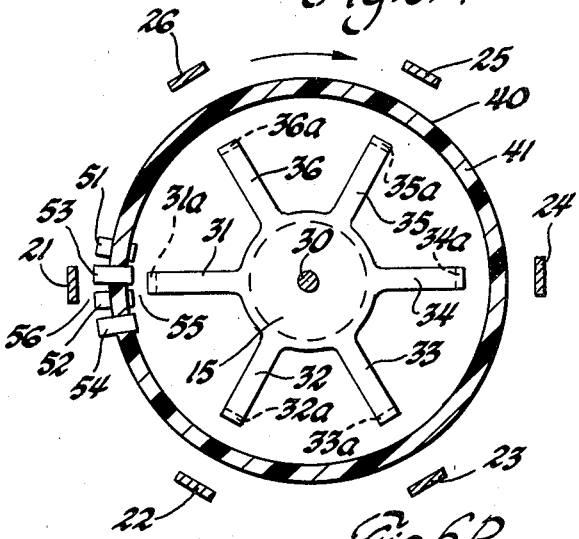
Figure 6C:
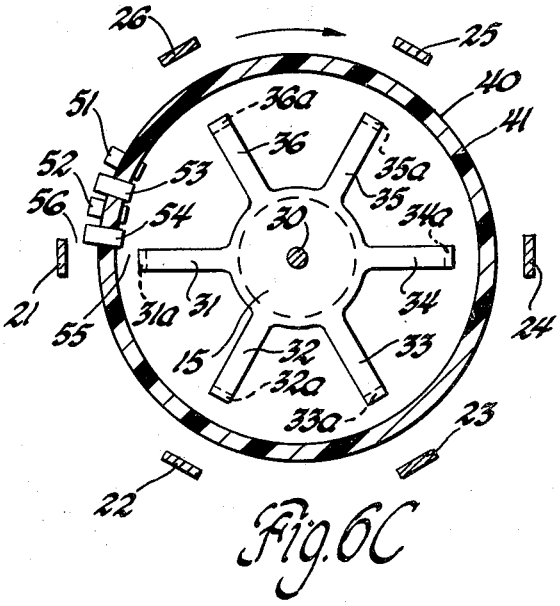

FIG. 6 diagrammatically sets forth three different angular positions of conductive inserts 51–54 with rotatable member 40 rotating in a clockwise direction as indicated by the arrows. Upon the occurrence of an ignition spark energy potential when conductive inserts 51–54 are in the position as indicated by FIG. 6A, the system is firing in the advance position and the ignition spark energy potential is transmitted from conductive member 31 of ignition spark energy conductive circuit 15 across spark gap 55 to conductive insert 51 and across spark gap 56 to distributor output electrode 21. Upon the occurrence of an ignition spark energy potential when conductive inserts 51–54 are in the position as indicated in FIG. 6B, the system is firing at the midpoint of the total distributor range. The ignition spark energy potential is transmitted from the conductive member 31 of ignition spark energy conductive circuit 15 across spark gap 55 to either or both of conductive inserts 52 and 53 and across spark gap 56 to distributor output electrode 21. Upon the occurrence of an ignition spark energy potential when conductive inserts 51–54 are in the position as indicated in FIG. 6C, the system is firing in the retard position and the ignition spark energy potential is transmitted from conductive member 31 of ignition spark energy conductive circuit 15 across spark gap 55 to conductive insert 54 and across spark gap 56 to distributor output electrode 21. When firing in the advance position, for the system to cross fire to distributor output electrode 22, the ignition spark energy must be transmitted from conductive member 31 of ignition spark energy conductive circuit 15 across spark gap 55 to conductive insert 51, across the gap between conductive inserts 51 and 53, across the gap between conductive inserts 53 and 52, across the gap between conductive inserts 52 and 54 and across the space between conductive insert 54 and distributor output electrode 22. To cross fire to distributor output electrode 22, therefore, the ignition spark energy must travel a greater distance than to the proper distributor output electrode 21. When the system is firing in the retard position as indicated by FIG. 6C, for the system to cross fire to distributor output electrode 26, the ignition spark energy must be transmitted from conductive member 31 of ignition spark energy conductive circuit 15 across spark gap 55 to conductive insert 54, across the gap between conductive inserts 54 and 52, across the gap between conductive inserts 52 and 53, across the gap between conductive inserts 53 and 51 and across the space between conductive insert 51 and distributor output electrode 26. To cross fire to distributor output electrode 26, therefore, the ignition spark energy must travel a greater distance than to the proper distributor output electrode 21. In this embodiment the staggered arrangement of the conductive inserts in two different planes provides a greater cross fire distance than does the other embodiment of FIGS. 1, 2 and 3.

Although in the embodiment of FIGS. 4 and 6 there are two conductive inserts shown in each of the common planes, it is to be specifically understood that more or less may be located in either or both of the common planes or more than two common planes with more or less than two conductive inserts located in each may be employed without departing from the spirit of the invention.

In the embodiments herein described, the space between the conductive inserts in each plane is substantially equal to the width of the ignition spark energy conductive circuit 15 conductive members 31–36.

With prior art six-cylinder engine distributors, the total ignition spark adjustment range between maximum ignition spark retard and maximum ignition spark advance that is obtainable without distributor cross fire is of the order of sixty engine crankshaft degrees. With the distributor of this invention, the total ignition spark adjustment range is of the order of one hundred engine crankshaft degrees.

While a preferred embodiment of the present invention has been shown and described, it will be obvious to those skilled in the art that various modifications and substitutions may be made without departing from the spirit of the invention that is to be limited only within the scope of the appended claims.

The embodiments of the invention in which an exclusive property or privilege is claimed are defined as follows:

1. An internal combustion engine ignition distributor for sequentially directing the ignition spark potential induced in the secondary winding of the engine ignition system ignition coil to the spark plugs of the engine comprising:

an output circuit corresponding to each said spark plug of an associated said internal combustion engine;

an ignition spark energy conductive circuit arranged for electrical connection to a said ignition coil secondary winding and so formed and positioned that it is substantially equally spaced from each of said output circuits;

a rotatable member of an insulating material arranged to be rotated in timed relationship with an associated said internal combustion engine and having an annular insulating rib portion disposed between said ignition spark energy conductive circuit and said output circuits; and two circumferentially spaced juxtaposed conductive inserts supported by and extending through said annular insulating rib portion in such a location that each passes in spark gap relationship with both said ignition spark energy conductive circuit and successive ones of said output circuits when said rotatable member is rotated.

2. An internal combustion engine ignition distributor for sequentially directing the ignition spark potential induced in the secondary winding of the engine ignition system ignition coil to the spark plugs of the engine comprising:

an output circuit corresponding to each said spark plug of an associated said internal combustion engine;

an ignition spark energy conductive circuit arranged for electrical connection to a said ignition coil secondary winding and so formed and positioned that it is substantially equally radially spaced from each of said output circuits;

a rotatable member of an insulating material arranged to be rotated in timed relationship with an associated said internal combustion engine and having an annular insulating rib portion disposed between said ignition spark energy conductive circuit and said output circuits; and two radial circumferentially spaced juxtaposed conductive inserts supported by and extending through said annular insulating rib portion in such a location that each passes in spark gap relationship with both said ignition spark energy conductive circuit and successive ones of said output circuits when said rotatable member is rotated.

3. An internal combustion engine ignition distributor for sequentially directing the ignition spark potential induced in the secondary winding of the engine ignition system ignition coil to the spark plugs of the engine comprising:

an output circuit corresponding to each said spark plug of an associated said internal combustion engine;

an ignition spark energy conductive circuit arranged for electrical connection to a said ignition coil secondary winding and so formed and positioned that it is substantially equally spaced from each of said output circuits;

a rotatable member of an insulating material arranged to be rotated about a central axis in timed relationship with an associated said internal combustion engine and having an annular insulating rib portion disposed between said ignition spark energy conductive circuit and said output circuits; and two spaced juxtaposed conductive inserts supported by said annular insulating rib portion in a common plane that is substantially normal to said central axis and intersects both said ignition spark energy conductive circuit and said output circuits, said conductive inserts extending through said annular insulating rib portion and being of such a dimension substantially in the direction of said plane that each is in spark gap relationship with both said ignition spark energy conductive circuit and successive ones of said output circuits when said rotatable member is rotated.

4. An internal combustion engine ignition distributor for sequentially directing the ignition spark potential induced in the secondary winding of the engine ignition system ignition coil to the spark plugs of the engine comprising:

an output circuit corresponding to each said spark plug of an associated said internal combustion engine;

an ignition spark energy conductive circuit arranged for electrical connection to a said ignition coil secondary winding and so formed and positioned that it is substantially equally spaced from each of said output circuits;

a rotatable member of an insulating material arranged to be rotated about a central axis in timed relationship with an associated said internal combustion engine and having an annular insulating rib portion disposed between said ignition spark energy conductive circuit and said output circuits; and two spaced juxtaposed conductive inserts supported by said annular insulating rib portion in a first plane that is substantially normal to said central axis and intersects both said ignition spark energy conductive circuit and said output circuits and at least one other conductive insert supported by said annular insulating rib portion in a second plane that is substantially normal to said central axis, is displaced from said first plane substantially in the direction of said central axis and intersects both said ignition spark energy conductive circuit and said output circuits with said conductive inserts of respective said planes being out of register, said conductive inserts extending through said annular insulating rib portion and being of such a radial dimension that each is in spark gap relationship with both said ignition spark energy conductive circuit and successive ones of said output circuits when said rotatable member is rotated.

5. An internal combustion engine ignition distributor for sequentially directing the ignition spark potential induced in the secondary winding of the engine ignition system ignition coil to the spark plugs of the engine comprising:

an output electrode corresponding to each said spark plug of an associated said internal combustion engine;

an ignition spark energy conductive circuit arranged for electrical connection to a said ignition coil secondary winding and having a conductive member corresponding to each said output electrode, said circuit being supported and positioned in such a manner that each said conductive member is in register with and spaced from the corresponding said output electrode;

a rotatable member of an insulating material arranged to be rotated in timed relationship with an associated said internal combustion engine and having an annular insulating rib portion disposed between said ignition spark energy conductive circuit and said output electrodes; and two circumferentially spaced juxtaposed conductive inserts supported by and extending through said annular insulating rib portion in such a location that each passes in spark gap relationship with both said ignition spark energy conductive circuit and successive ones of said output electrodes when said rotatable member is rotated.

6. An internal combustion engine ignition distributor for sequentially directing the ignition spark potential induced in the secondary winding of the engine ignition system ignition coil to the spark plugs of the engine comprising:

an output electrode corresponding to each said spark plug of an associated said internal combustion engine;

an ignition spark energy conductive circuit arranged for electrical connection to a said ignition coil secondary winding and having a conductive member including a portion extending angularly therefrom corresponding to each said output electrode, said circuit being supported and positioned in such a manner that the said angularly extending portion of each said conductive member is in register with and radially spaced from the corresponding said output electrode;

a rotatable member of an insulating material arranged to be rotated in timed relationship with an associated said internal combustion engine and having an annular insulating rib portion disposed between said ignition spark energy conductive circuit and said output electrodes; and two radial circumferentially spaced juxtaposed conductive inserts supported by and extending through said annular insulating rib portion in such a location that each passes in spark gap relationship with both said ignition spark energy conductive circuit and successive ones of said output electrodes when said rotatable member is rotated.

7. An internal combustion engine ignition distributor for sequentially directing the ignition spark potential induced in the secondary winding of the engine ignition system ignition coil to the spark plugs of the engine comprising:

an output electrode corresponding to each said spark plug of an associated said internal combustion engine;

an ignition spark energy conductive circuit arranged for electrical connection to a said ignition coil secondary winding and having a conductive member corresponding to each said output electrode, said circuit being supported and positioned in such a manner that each said conductive member is in register with and spaced from the corresponding said output electrode;

a rotatable member of an insulating material arranged to be rotated about a central axis in timed relationship with an associated said internal combustion engine and having an annular insulating rib portion disposed between said ignition spark energy conductive circuit and said output electrodes; and two spaced juxtaposed conductive inserts supported by said annular insulating rib portion in a common plane that is substantially normal to said central axis and intersects both said ignition spark energy conductive circuit and said output electrodes; said conductive inserts extending through said annular insulating rib portion and being of such a dimension substantially in the direction of said plane that each is in spark gap relationship with both said ignition spark energy conductive circuit and successive ones of said output electrodes when said rotatable member is rotated.

8. An internal combustion engine ignition distributor for sequentially directing the ignition spark potential induced in the secondary winding of the engine ignition system ignition coil to the spark plugs of the engine comprising:

an output electrode corresponding to each said spark plug of an associated said internal combustion engine;

an ignition spark energy conductive circuit arranged for electrical connection to a said ignition coil secondary winding and having a conductive member including a portion extending angularly therefrom corresponding to each said output electrode, said circuit being supported and positioned in such a manner that the said angularly extending portion of each said conductive member is in register with and radially spaced from the corresponding said output electrode;

a rotatable member of an insulating material arranged to be rotated about a central axis in timed relationship with an associated said internal combustion engine and having an annular insulating rib portion disposed between said ignition spark energy conductive circuit and said output electrodes; and two spaced juxtaposed conductive inserts supported by said annular insulating rib portion in a first plane that is substantially normal to said central axis and intersects both said ignition spark energy conductive circuit and said output electrodes and at least one other conductive insert supported by said annular insulating rib portion in a second plane that is substantially normal to said central axis, is displaced from said first plane substantially in the direction of said central axis and intersects both said ignition spark energy conductive circuit and said output electrodes with said conductive inserts of respective said planes being out of register, said conductive inserts extending through said annular insulating rib portion and being of such a radial dimension that each is in spark gap relationship with both said ignition spark energy conductive circuit and successive ones of said output electrodes when said rotatable member is rotated.

* * * * *